United States Patent [19]

Trimble

[11] 4,133,737

[45] Jan. 9, 1979

[54] SHIELDED ANODES

[75] Inventor: John O. Trimble, Malverne, Pa.

[73] Assignee: Exxon Research & Engineering Co., Florham Park, N.J.

[21] Appl. No.: 810,299

[22] Filed: Jun. 27, 1977

[51] Int. Cl.[2] ..... C23F 13/00

[52] U.S. Cl. ..... 204/197; 204/282

[58] Field of Search ..... 204/196, 197, 282, 292, 204/293

[56] References Cited

U.S. PATENT DOCUMENTS

| | | | |
|---|---|---|---|
| 3,515,654 | 6/1970 | Bordalen et al. | 204/197 |
| 3,616,421 | 10/1971 | Mackintosh | 204/197 |
| 3,960,698 | 6/1976 | Bortak | 204/256 |
| 4,051,009 | 9/1977 | Schweikart et al. | 204/268 |

*Primary Examiner*—T. Tung

*Attorney, Agent, or Firm*—F. Donald Paris

[57] ABSTRACT

A shielded anode, preferably of the aluminum type, comprising an elongated anode body encased on all sides including the top, bottom and the ends by a sheathing which comprises a pair of plastic casings including an inner casing which is in direct contact with the anode body, at least at the corners thereof, and an outer casing surrounding said inner casing and in contact therewith at least at the corners thereof. The outer casing is further supported by spacer members located between the outer surface of the inner casing and the inner surface of the outer casing. The inner casing includes a plurality of spaced elongated openings on all the sides and the outer casing includes a plurality of small openings offset with respect to the inner casing openings for permitting good, essentially free contact between the anode and the sea water electrolyte, which is also the primary corrodent, while preventing direct contact between other metals or spark-producing surfaces and said anode body in the event of accidental dropping of the anode or impact from another object falling onto the anode assembly. The ends of both casings are flattened such that opposing sides are contiguously disposed and sealed together by appropriate heat sealing of rivets or molded end caps. A metal elongated support rod extending through the anode body extends outwardly at either end thereof through the flattened sealed casing end portions for providing means to support the anode within the hull of the tanker on the various support structures and to provide a metallic electrical connection between the anode and the ship structure.

12 Claims, 6 Drawing Figures

10
12
14
18
20
22
24
26
28
30
32
4
4

12
14
18
20
22
24
26
28

10
14
16
17
21
22
24
30
32

SHIELDED ANODES

CROSS REFERENCE TO RELATED APPLICATIONS

An application Ser. No. 775,572 filed Dec. 30, 1976 entitled "Shielded Anodes" assigned to the assignee of the present invention, now abandoned in favor of Continuation-in-Part U.S. application Ser. No. 826,526, filed Aug. 22, 1977, discloses protective shielding for anodes.

BACKGROUND OF THE INVENTION

The present invention relates to anodes for use in controlling corrosion and more particularly to providing an improved protective shield and sheathing for such anodes which will not interfere with the normal corrosion protection afforded by the anode but which will prevent accidental impact between the anode and another metallic object.

Typically the corrosion of metals in sea water and other aqueous environments is an electrochemical process, wherein a flow of electrons takes place between certain areas of the metal surface in contact with the aqueous solution which is capable of conducting an electric current. The result of this electrochemical process is deterioration or eating away of the metal in those areas which are commonly referred to as anodes and at which the electrons leave the metal. Metal ions enter into the solution and the metal corrodes. The area receiving the electrons and becoming more negative is termed the cathode. There electrons are discharged to the sea water electrolyte. The cathode also must be present to complete a circuit. These two electrodes may comprise different metals or different areas on the same piece of metal due to impurities on the surface, differences in surface structure, etc. A common and well-known example of such an electrochemical action is the dry cell battery principle which provides energy to make the flashlight operate. Another similar example is an unprotected hull of the ship in sea water, the primary difference being that there is no switch to cut off the flow of electrons and, furthermore, the presence of the reaction is undesirable. In the case of a ship's hull, since the amount of electrons the earth can accept is near infinity, the process will continue until the hull is completely wasted away and, as long as the flow of electrons is unimpeded through a path of low resistance, the rate of wastage will be very rapid.

This electron flow is generally termed a galvanic process. It will tend to continue in the absence of the application of an equal or greater opposing force, which if applied, can greatly reduce the rate of the galvanic process or corrosion can be stopped completely. This is accomplished by supplying a sufficient number of electrons from another more powerful source so that the supply will make the structure to be protected the cathode. The application of such an opposing force would provide the surplus of electrons without a loss of steel and is well known as cathodic protection. Using this type of protection means being prepared to sacrifice another material or energy for that purpose, which is the primary function of cathodic protection. By permitting the electrons from the galvanic anode to flow to a tanker hull or tank surface which has a more positive potential, i.e. cathodic, the desired protective function is obtained. The rate of electron flow depends on the driving force or potential difference between the metals, i.e. the voltage difference between the corroding site known as the anode and the protected site known as the cathode.

In the case of unprotected ballast tanks in tankers, corrosion also takes place although there is no dissimilarity in metals. The corrosion is substantial because of the basic princple involved which is the same as explained above in the ship's hull example. Thus, surface imperfections, orientations in granular structure of the metal, lack of homogeneity, localized stresses and variations in geometry or shape and environment cause the formation of large numbers of localized anodes and cathodes on the surface of the metal. The galvanic action results in anodic corrosion, i.e. corrosion at the anode site in comparison to the protected site which is the cathode. This corrosion is commonly prevented, or at least minimized, by using sacrificial anodes which are typically cast on support rods or cores and fixed at various locations throughout the tank in order to provide for complete protection. Hence, it is often desirable to place anodes at many elevations from top to bottom. Generally, the schemes employed for mounting the anodes are regulated by the U.S. Coast Guard. Presently various ship classification societies and the U.S. Coast Guard permit installation of aluminum anodes only in the lower levels of cargo/ballast tanks and other locations where a free fall of the anode cannot result in an impact of more than 200 foot pounds energy. Impacts of greater energy between aluminum and rusted steel can produce hot aluminum fragments capable of igniting petroleum gases existing above the liquid level or when the tank is free of liquids. Present practice permits installation of the zinc anodes at greater heights because impacts between zinc and steel are less hazardous.

It is apparent that in order to achieve a completely safe anode environment system, it is desirable to completely eliminate any metal-to-metal impact possibilities. The prevention of impact should encompass not only those resulting from accidental detachment of the anode but also impact from an object falling onto the anode from above. If these objectives can be met then the use of aluminum anodes will be safe at any elevation in the tank.

Various attempts at protection of anodes have been proffered in the prior art. These include those such as disclosed in U.S. Pat. No. 3,488,275 which provide protection from physical abuse during shipping in the form of a fabric container for the anode. U.S. Pat. No. 2,976,226, generally discloses providing a sleeve on an anode to protect against oil or reaction products but not impact; however, the anode is of the impressed current type. U.S. Pat. No. 3,196,101 provides a mesh wrapped about an impressed current anode for protecting it against any falling pieces, but does not suggest protection against metal-to-metal impact.

SUMMARY OF THE INVENTION

The present invention relates to anodes and more particularly to an improved shielded anode, preferably the anode is aluminum, which is adapted for mounting in the tank of a cargo tanker. The main purpose of the shield about the anode is to avoid the possible ignition of a flammable gas by impact between the anode and other metal either by the anode falling or by another object falling onto the anode from above such as may occur when the tank is free of liquids.

Accordingly, the present invention provides for a shielded anode, comprising an elongated anode body encased on all sides, including the top, bottom and the ends by a sheathing which comprises a pair of plastic casings including an inner casing which is in direct contact with the anode body, at least at the corners thereof, and an outer casing surroudning said inner casing and in contact therewith at least at the corners thereof and further supported by spacer members located between the outer surface of the inner casing and the inner surface of the outer casing. The inner casing includes a plurality of spaced, elongated openings on all the sides, and the outer casing includes a plurality of similar openings offset with respect to the openings in the inner casing for providing free access of ballast water electrolyte, thus permitting a continuous flow of electrons between said anode and the steel structure which is being protected from salt water corrosion. The shield configuration then prevents direct contact with said anode body in the event of accidental dropping or contact with another metal body during periods when the tank is partially or essentially free of liquids. The ends of both casings are flattened such that opposing sides are contiguously disposed and sealed together by appropriate heat sealing or rivets or alternatively can employ molded end caps secured to the sheathing for enclosing th anode ends. An elongated support rod extending through the body extends outwardly at either end thereof through the end closures for providing means to support the anode within the hull of the tanker on its various structures and to provide a metallic electrical metal connection between the anode and the ship hull.

Thus, the present invention provides for a novel improved shielded anode which operates normally, e.g. in a tank of a cargo carrying tanker, by providing protection to the anode structure when immersed in an electrolyte. There is a free flow of electrons from the anode to the cathodic structure is continuous through the completed circuit formed by the electrolyte which readily passes through offset openings provided in the shield. The offset arrangement of the openings prevents undesirable impact with other metal bodies or structures within the tank particularly during periods when liquid levels are below anode locations.

The foregoing and other objects, features and advantages of the invention will be apparent from the following more particular description of the preferred embodiments of the invention as illustrated in the accompanying drawings.

It has generally been described that cathodic protection with sacrifical anodes is a primary method employed to prevent or minimize corrosion in ballast tanks on liquid carrying tankers. To insure and provide for adequate safety, it is necessary to prevent, for example, in the case of employing aluminum anodes, aluminum-steel impacts with energy exceeding 200 ft. lbs. The present invention is directed towards the shielding of anodes with a plastic guard or protective casing to prevent impact. Such shielded anodes can be employed in a safe manner at any elevation.

Towards this end the anode is sheathed in a plastic protective casing which eliminates direct contact with another metal structure.

Figure 1:
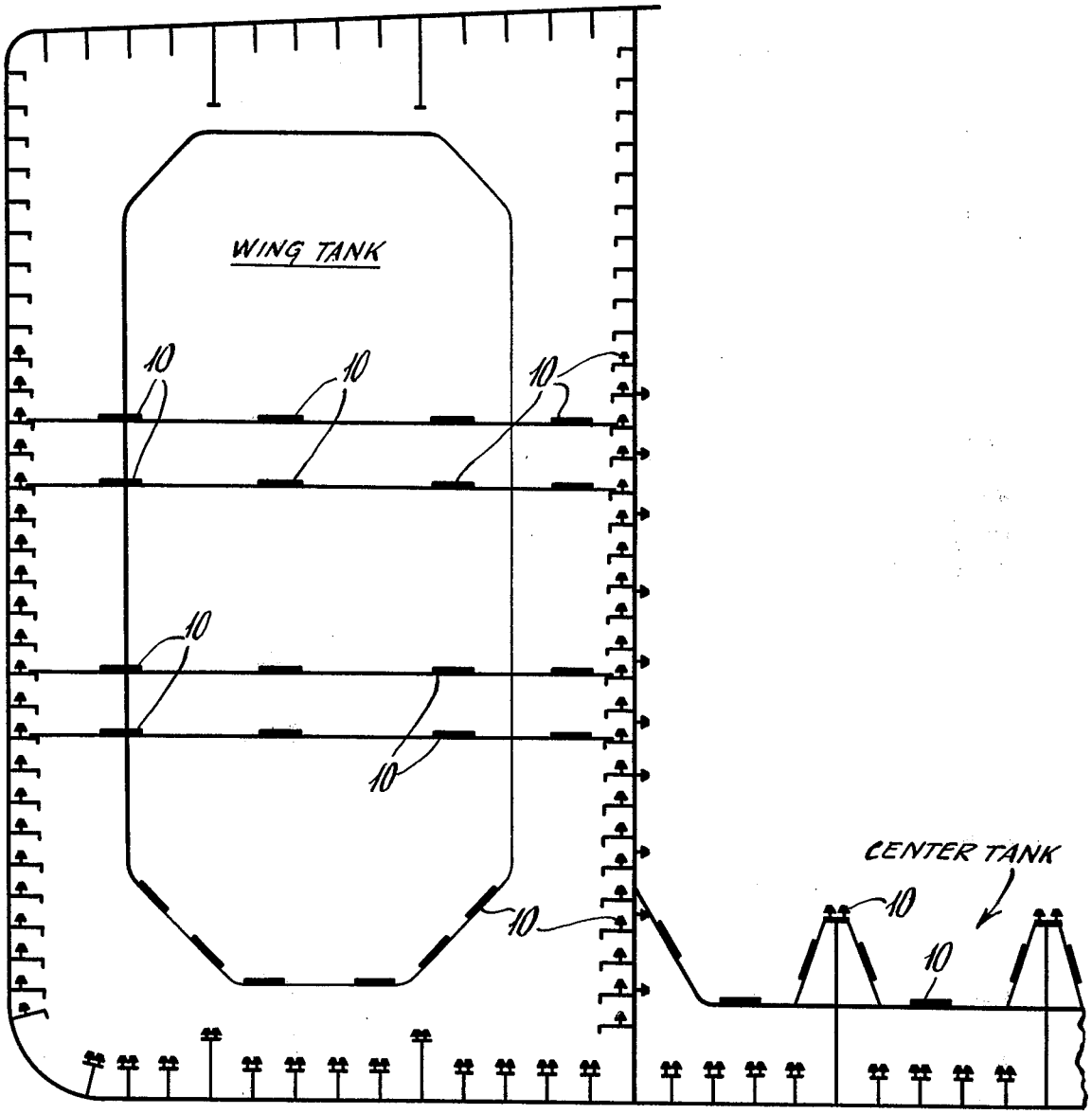
FIG. 1 illustrates a typical transverse cross section of a wing tank and part of a center tank in a tanker for carrying liquid hydrocarbons or sea water ballast and which includes an array of anodes positioned in accordance with conventional practice and constructed in accordance with the present invention.
Figure 3:
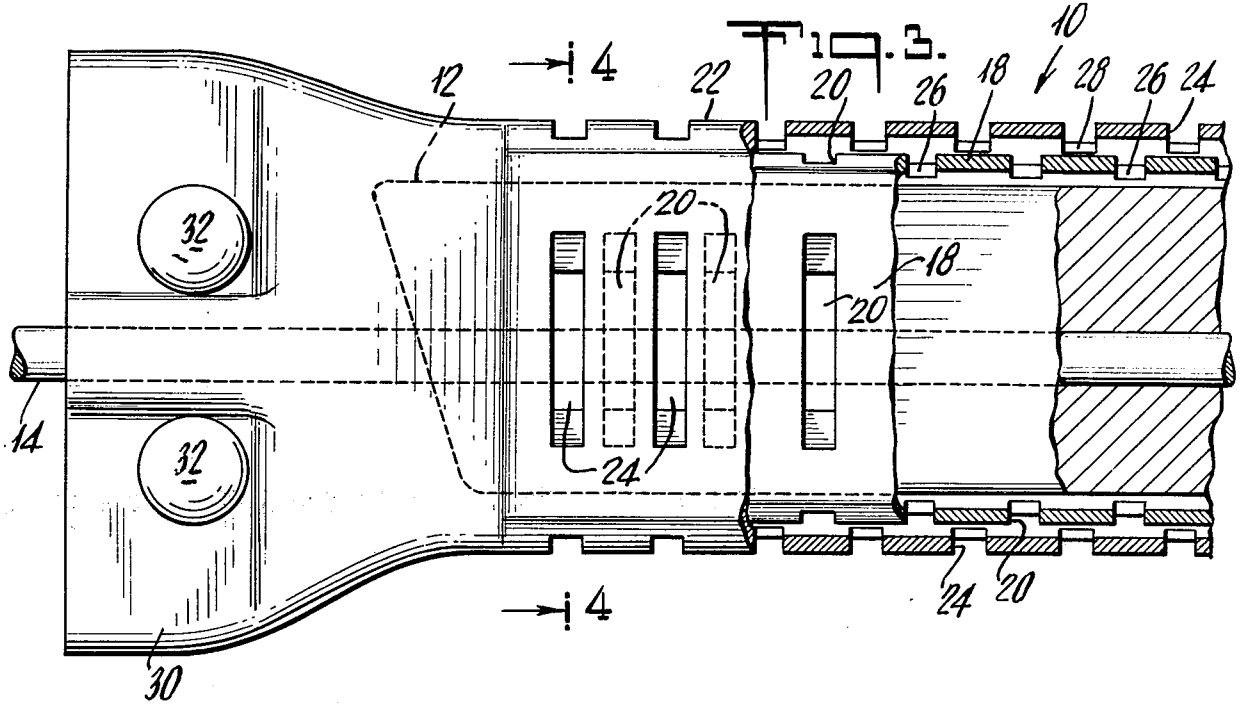
FIG. 3 illustrates a partial side elevation view of the anode of FIG. 2, illustrating in greater detail the relationship between the sheathing openings.
Figure 4:
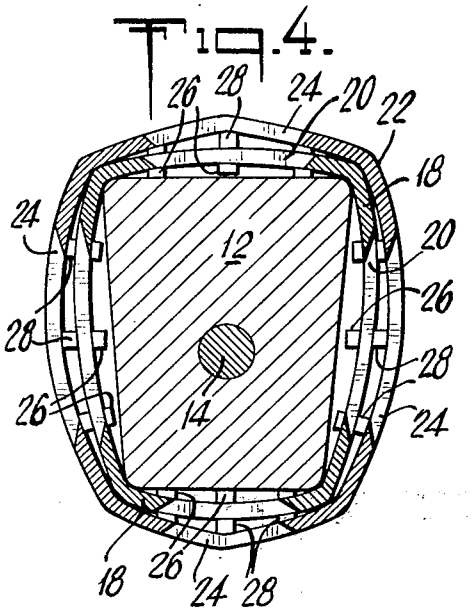
FIG. 4 is a cross sectional view taken substantially on the line 4—4 of FIG. 3.
Figure 2:
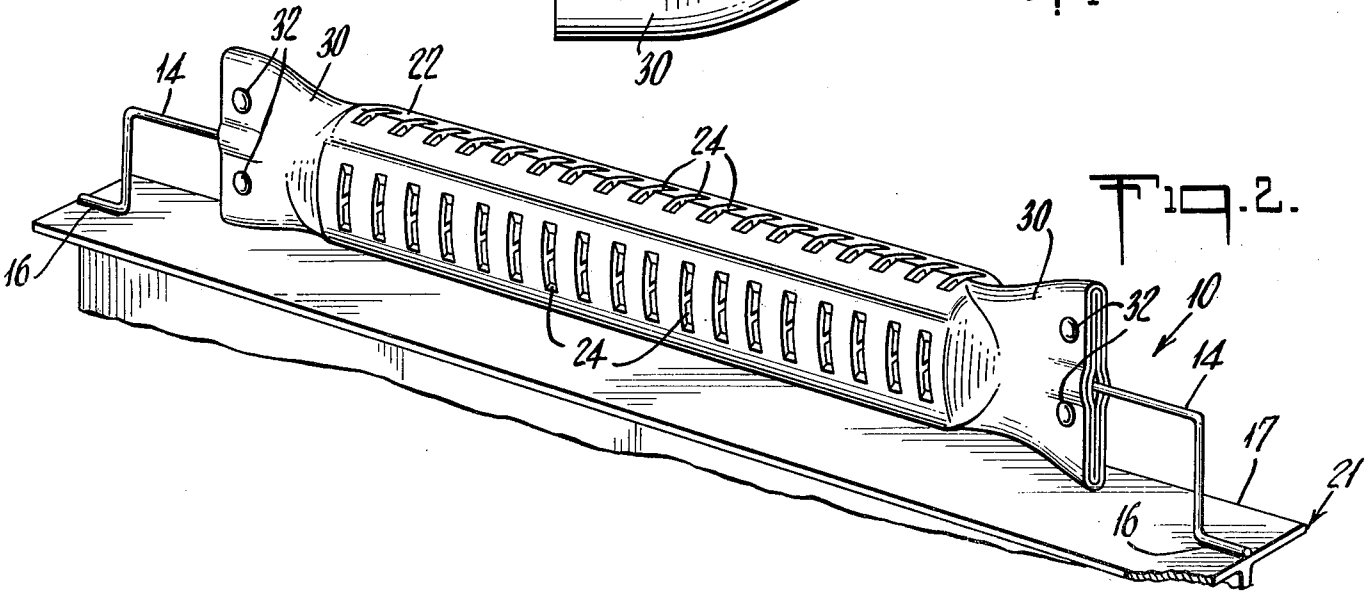
FIG. 2 illustrates a perspective view of a shielded anode constructed according to the present invention.

FIG. 1 illustrates a typical section through the standard wing and center tanks on a tanker and schematically shows an array of anodes constructed according to the present invention and generally designated 10 which are situated throughout the tank located on various structural members of the tank. The particular arrangement of the anodes is not deemed to be a part of the present invention and is merely shown for purposes of illustration. Reference is made to FIGS. 2 through 4 for further details on the construction of the anode shield which will be described in conjunction with their mounting which is considered conventional, although described for purposes of completeness of this disclosure. Each anode typically comprises a main anode body 12 which may have any suitable shape such as a tapezoidal cross-section or rectangular as shown in the present drawings. The body is elongated and has extending through the body and outward at each end a steel support rod 14 which may be bent at each end downwardly and then outwardly at right angles to the downward extending portion in order to provide a means for mounting the anode to the tank structure. The end portion of the rod may be welded as shown at 16 to the standard flange 18 of the bottom hull stiffeners 20 which are secured to the bottom hull of the tanker or fastened by any other acceptable means.

The shielded anode is best illustrated in FIG. 2. The anode 14 is preferably aluminum, although it can be of other types if desired and is completely encased in a sheathing generally designated 16. The sheathing basically comprises a pair of casings including an inner casing 18 having a plurality of elongated openings 20 on all sides thereof, and an outer casing 22 which surrounds and is in spaced contact with the inner casing and also includes a similar plurality of spaced openings 24 on the all sides thereof. The casings typically may be made of an appropriate plastic material such as Surlyn TM. The plastic may contain an additive such as carbon black to render it partially conductive. This will ensure that a detached anode resting on tank structure without metal contracts will not be highly electrically insulated. It is normal industry practice to avoid highly insulated metal objects in cargo tanks when there may be an electrostatic charge as for example the charged mist produced by tank washing. The inner casing is in contact with the anode at least at the corners thereof and further centrally located on each side of the inner casing between the inner surface and the anode main body are a plurality of ribs 26 which further support the sides and including the top and bottom of the inner casing with respect to the outer surface of the anode body. When enclosing the anode in the plastic casing it generally conforms to the shape of the anode body. The outer casing 22 surrounds and is in spaced contact with the inner casing also being in contact with the latter, at least at the corners thereof, and also has a plurality of ribs 28 on the sides including the top and bottom thereof for spacing those portions of the casing with respect to corresponding portions of the inner casing. The number and location of the spacing ribs may vary. The outer casing as best shown in FIG. 3 includes a plurality of openings 24 which are elongated (although they may take other configurations) and are similar to those openings 20 in the inner casing 18; however, the outer openings are arranged such that they are offset, i.e. spaced between or transversely of corresponding similar openings in the inner casing. The offset relationship between the inner and outer openings is such that the flow of ions through the electrolyte which comprises the water within the tank in which they are mounted, will continue in an efficient manner for protection or at least controlling corrosion within the tank. At the same time is offset relationship of the outer and inner openings will prevent any objects from impacting against the anode body and thus causing a potentially hazardous situation from arising. In the event that the anode were to accidently fall from its mount and contact another metal body, the plastic shield would not only prevent impact with the anode, but also the offset relationship of the openings would prevent any direct contact with that body. The nature of the material and its overall construction with respect to the inner casing in effect provides a cushion or barrier against anode impact. Each of the casings is secured about the anode in a continuous molded form such that the outer casing is larger in size than the inner one; however, the anode is first inserted into the casing which would take initially a general tubular configuration and upon insertion of the anode would assume generally the configuration or shape of the anode. The outer casing is then placed in overlying relationship with respect to the inner casing such that the openings are offset and the ends of the inner and outer casings are than flattened into the general thin configuration like a fin 30 best shown in FIGS. 2 and 3, whereupon rivets 32 are placed between opposed portions and completely through the fin in order to seal them together. The support rod extends through the anode and proceeds through the end fins to the mounting support.

Figure 5:
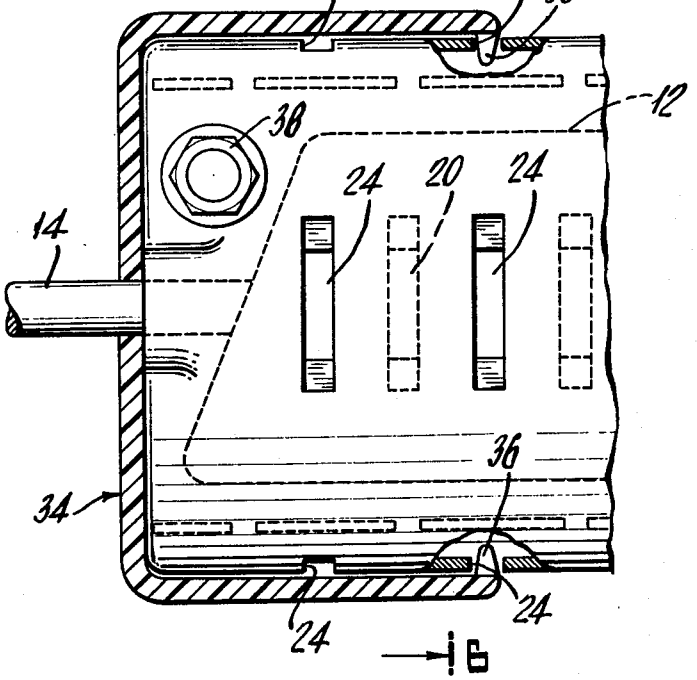
FIGS. 5 & 6 are alternate embodiments illustrating a different type of end closure which can be employed to enclose the ends of the shielded anode.
Figure 6:
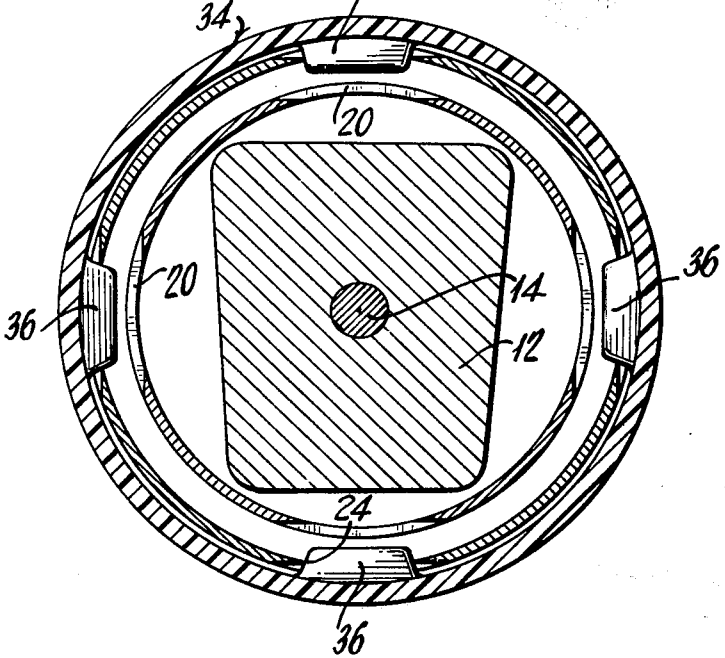

FIGS. 5 and 6 show the anode ends enclosed by means of molded end caps 34 (e.g. Surlyn) which include inward extending locking tabs 36 at the open end thereof. These tabs engage grooves which would typically comprise openings 24 formed in and about the outer shield 22 and extend through the grooves toward the inner shield 18. The end cap/shield connection can be made permanent by a heat seal or some other appropriate means such as the illustrated Surlyn or Nylon nut and bolt 38. The outer end of the cap can be either domed (shown dotted) or flat.

Other modifications and variations to the aforedescribed design may include providing more than two protection layers which will depend on the particular situation taking into account elevation, desired impact, resistance, etc.

While a preferred embodiment and various modifications thereof have been disclosed it will be apparent to those of ordinary skill in the art upon reading this disclosure that other modifications and variations can be made. Accordingly, reference should be made to the appended claims for determining the full and complete scope of the present invention.

What is claimed is:

1. A shielded anode for controlling corrosion when immersed, comprising:

a main anode body and sheathing substantially surrounding said body, said sheathing comprising an inner shield and an outer shield fixed relative to each other, a plurality of spacer members extending between said inner and outer shields and between said inner shield and said body for maintaining said shields and said body in spaced relation respectively, said inner shield including a first plurality of openings and said outer shield including a second plurality of openings, said first and second plurality of openings being fixedly arranged relative to each other respectively for preventing direct impact with said body.

2. The shielded anode of claim 1 wherein said sheathing completely surrounds said anode body.

3. The shielded anode of claim 1 wherein said sheathing is closed at the opposite ends thereof by common fastening means at each of said ends.

4. The shielded anode of claim 1 wherein said sheathing comprises a plastic material.

5. The sheathing of claim 1 wherein said spacer members comprise a plurality of ribs extending from each of said inner and outer shields.

6. The shielded anode of claim 1 wherein said anode comprises aluminum.

7. The shielded anode of claim 1 wherein said sheathing comprises a material sufficient for withstanding impact and permitting electron flow from said anode when said anode is immersed in an electrolyte.

8. The shielded anode of claim 1 wherein said inner and outer shields each have a plurality of spacer members extending therefrom in the direction toward said anode body.

9. The shielded anode of claim 1 wherein said first and second openings are arranged in fixed offset relationship.

10. The shielded anode of claim 1 including cap means at opposite ends of said sheathing for enclosing the ends of said anode body.

11. The shielded anode of claim 10 wherein said end caps are secured in place to said sheathing, said end caps including end portions in locked engagement with groove means formed in said sheathing.

12. The shielded anode of claim 10 wherein said end caps comprise a domed configuration.

* * * * *